US005189389A

United States Patent [19]

DeLuca et al.

[11] Patent Number: 5,189,389

[45] Date of Patent: Feb. 23, 1993

[54] ELECTRONIC DEVICE HAVING POSITION SELECTABLE ALERT MODES

[75] Inventors: Joan S. DeLuca; Michael J. DeLuca, both of Boca Raton, Fla.

[73] Assignee: Motorola, Inc., Schaumburg, Ill.

[21] Appl. No.: 513,533

[22] Filed: Apr. 23, 1990

[51] Int. Cl.[5] ..... H04Q 1/30

[52] U.S. Cl. ..... 340/311.1; 340/686; 340/692; 455/100

[58] Field of Search ..... 340/311.1, 692, 517, 340/686, 825.44, 825.45, 825.46; 455/351, 100; 200/61.45, 61.52, DIG. 2

[56] References Cited

U.S. PATENT DOCUMENTS 4,206,926 6/1980 Stave ..... 340/686
4,626,850 12/1986 Chey ..... 340/904
4,817,194 3/1989 Andros, Jr. ..... 455/154
4,876,536 10/1989 Matai et al. ..... 340/311.1
4,918,438 4/1990 Yamasaki ..... 340/825.44
4,952,927 8/1990 DeLuca et al. ..... 340/311.1

*Primary Examiner*—Donnie L. Crosland
*Attorney, Agent, or Firm*—Philip P. Macnak; William E. Koch; Thomas G. Berry

[57] ABSTRACT

An electronic device (FIG. 1) includes a sensor (17) for determining when the electronic device (FIG. 1) is being worn by a user and when the elecronic device (FIG. 1) is not being worn by the user. A first altering device (21) provides a first alert and a second altering device (22) provides a second alert. An alert selection device (16) which is coupled to the sensor (17) alternatively activates the first alerting device (21) when the electronic device (FIG. 1) is being worn by the user and the second alerting device (22) when the electronic device (FIG. 1) is not being worn by the user.

16 Claims, 2 Drawing Sheets

ELECTRONIC DEVICE HAVING POSITION SELECTABLE ALERT MODES

FIELD OF THE INVENTION

This invention relates in general to selectable alert modes, and more specifically, to an electronic device having an alert mode selected by its position in respect to another object.

BACKGROUND OF THE INVENTION

Selective call radio receivers, such as pagers, alert the user of a received signal addressed to that particular selective call receiver. Each selective call receiver is identified by a specific address that typically precedes each message. Such devices generally incorporate a radio receiver capable of producing for example, either an audible alert (which may be heard by the user) or a tactile alert (such as a vibrating sensation which may be felt by the user). Some pagers also provide a voice or a visually displayed message on a screen. When the selective call receiver receives a message, preceded by the selective call receiver's address, the message is stored within a memory for subsequent presentation.

However, pagers in a vibratory alert mode, when placed in a charger or on a desk, may vibrate off the desk or out of the charger when alerting that a page has been received. This will, at times, result in costly repairs to these units. Furthermore, a vibratory alert for a pager normally attached to a belt may go unnoticed when the pager is placed in a purse, for example. The user cannot always be expected to remember to manually change the mode as may be needed due to the continuous movement of these devices.

Therefore, a selectable alert mode is needed that selects one of two or more alerts respective to the location of the selective call receiver.

SUMMARY OF THE INVENTION

An electronic device comprising a sensor for determining when the electronic device is being worn by a user and when the electronic device is not being worn by the user. A first alerting device provides a first alert and a second alerting device provides a second alert. An alert selection device which is coupled to the sensor alternatively activates the first alerting device when the electronic device is being worn by the user and the second alerting device when the electronic device is not being worn by the user.

DETAILED DESCRIPTION OF THE INVENTION

Figure 1:
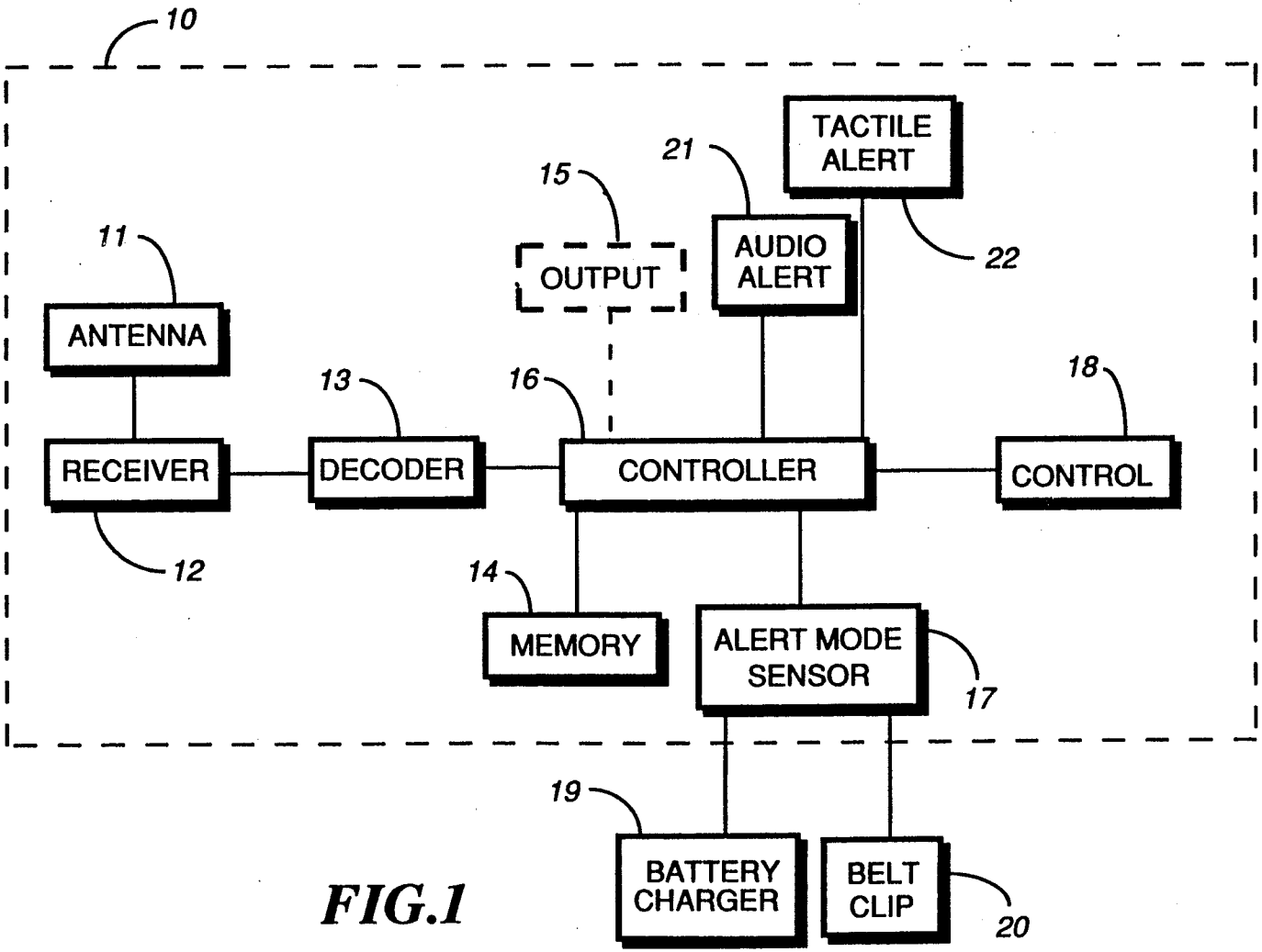
FIG. 1 is a block diagram of the preferred embodiment of the present invention.

Referring to FIG. 1, a selective call radio receiver 10 (e.g., a pager) comprises an antenna 11 that provides an RF carrier signal that is mixed with a local oscillator signal and an injection signal contained within the receiver module 12. The receiver module 12 also generates a signal suitable for processing by a decoder 13 in a manner well known to those skilled in the art. The decoder 13 converts the signal to an address which may also include an optional message data directed to some selective call receivers, and if the selective call receiver includes an optional voice output, a recovered audio components of the original R.F. signal may be received by the antenna 11. For a message or a voice selective call receiver, the recovered message or voice output is stored in a memory 14 for subsequent "playback" by an output module 15. A controller 16 compares the decoded results with predetermined addresses contained in the memory 14, and when substantially similar, alerts the user that a signal has been received, either by an audio alert (e.g., speaker) 21 or a tactile alert (e.g., vibrator) 22. The optional output module 15 will automatically, or when manually selected by controls 18, presents the message, such as by displaying the message on a display.

For a more detailed description of the structure and operation of a selective call radio paging receiver of the type shown in FIG. 1, reference is made to U.S. Pat. No. 4,518,961; U.S. Pat. No. 4,649,583; and U.S. Pat. No. 4,755,816; each of which are hereby incorporated by reference.

In accordance with the present invention, the alert mode sensor 17 selects one of the at least two alerts modes, (e.g., the audio alert 21 or the tactile alert 22). Depending on the relationship between the selective call receiver and another object, such as a battery charger 19, a belt clip 20, an article of clothing, or a land mass such as the earth, the alert mode sensor 17 may select one of at least two alert modes. A mercury switch contained within the alert mode sensor 17 may be used to sense gravity (e.g., the position of the selective call receivers with respect to the earth).

The information to enable the selection of an alert mode may be transmitted electrically (e.g., by a current flowing to one or more electrical contacts on the selective call receiver 10 and either the battery charger 19 or the belt clip 20). Thus, by placing the selective call receiver 10 in a battery charger 19 or a belt clip 20 where it makes an electrical contact on the enclosure, current will flow which may be used to select a user preferred alert mode (e.g., an audio alert 21 which may be in the form of a voice message).

Mechanically, the selection of a user preferred alert mode (e.g., audio alert 21) may be accomplished by activating an electrical/mechanical switch when the selective call receiver 10 is placed in another object such as a belt clip 20 or a battery charger 19. Also, the selective call receiver 10 may activate the alert mode sensor 17 magnetically by placing it next to or in another object with an attached magnet. The selective call receiver 10 may also activate the alert mode sensor 17 depending on its relative position with respect to gravity, by activating a mercury switch and selecting a user preferred alert mode.

Figure 2:
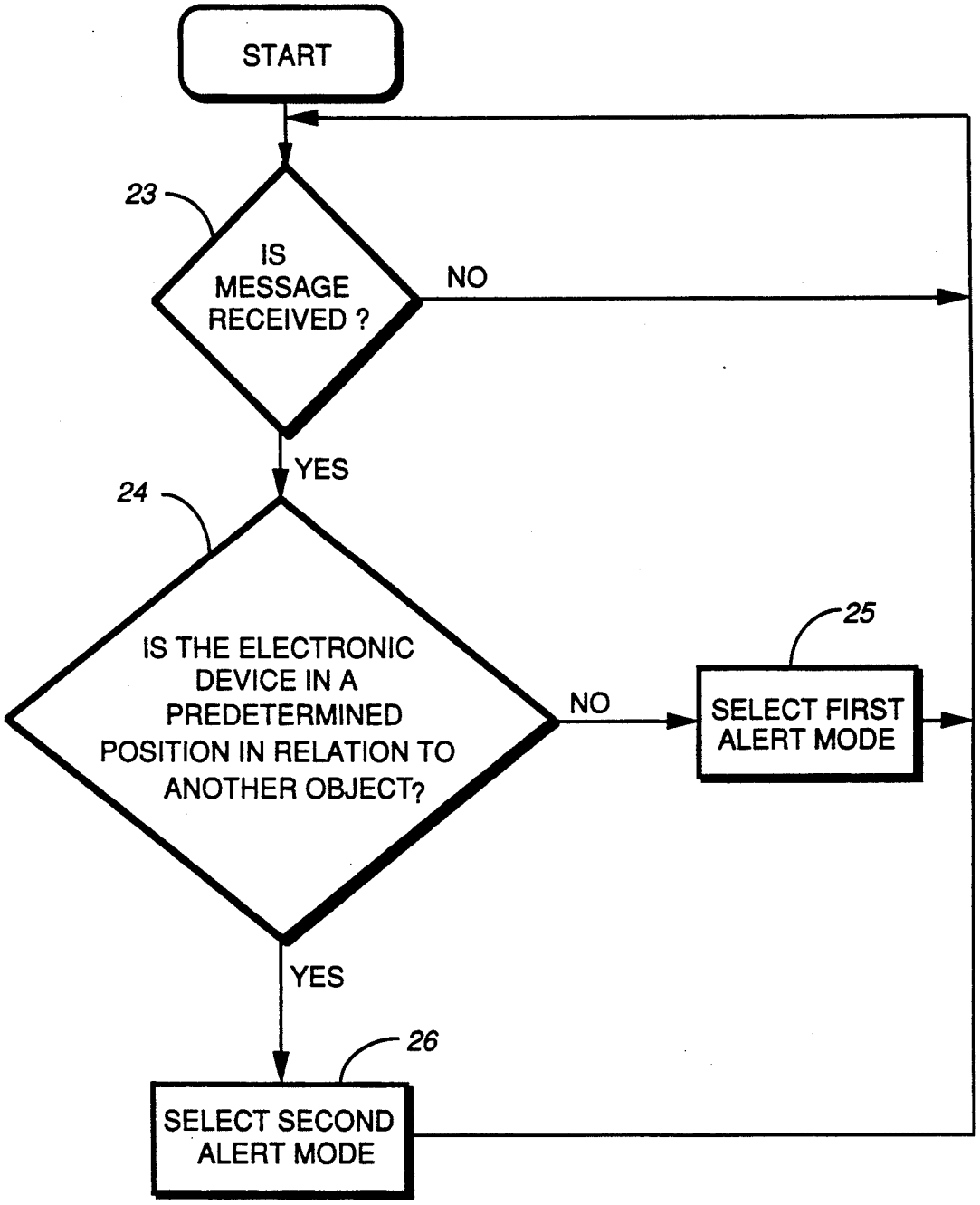
FIG. 2 is a flow diagram illustrating the preferred operation of the preferred embodiment.

Referring to FIG. 2, the selective call receiver may be in one of at least two alert modes. When a message is received by the selective call receiver, the first decision block 23 transfers process control to the next decision block 24. In the decision block 24, the alert mode sensor checks to see if a signal is received with respect to a predetermined position. If the selective call receiver is not in a predetermined position, the selective call receiver selects the first alert mode (step 25) and returns to the first decision block 23 to wait for the next message. If the selective call receiver is in a predetermined position, the selective call receiver selects the second alert mode (step 26) and again returns to the first decision block 23 to wait for the next message.

In summary, when a message is received by a selective call receiver comprising an alert mode sensor for determining the position of the selective call receiver in relation to another object, and an alert selector for selecting one of at least two alert modes in response to the position of the selective call receiver.

We claim:

1. An electronic device comprising:

sensor means for determining when the electronic device is being worn by a user and when the electronic device is not being worn by said user;

first alerting means for providing a first alert;

second alerting means for providing a second alert; and alert selection means, coupled to the sensor means, for alternatively activating the first alerting means when the electronic device is being worn by said user and the second alerting means when the electronic device is not being worn by said user.

2. The electronic device according to claim 1 wherein the first alerting means comprises an audio alert means for generating an audio alert in response to the alert selection means.

3. The electronic device according to claim 2 wherein the first alerting means further comprises a tactile alert means for generating a vibratory alert in response to the alert selection means.

4. The electronic device according to claim 1 wherein the second alerting means comprises a tactile alert means for generating a vibratory alert in response to the alert selection means.

5. The electronic device according to claim 1 further comprising an orientation means for determining whether the electronic device is in a first orientation in relation to gravity or in a second orientation in relation to gravity, wherein the alert selection means, in response to the orientation means, activates the first alerting means when the electronic device is positioned in said first orientation and activates the second alerting means when the electronic device is positioned in said second orientation.

6. The electronic device according to claim 1 wherein the sensor means comprises a magnetic sensor.

7. The electronic device according to claim 1 wherein the sensor means comprises a detection means for determining whether the electronic device is retained by a device.

8. The electronic device according to claim 7 wherein the retaining device comprises a belt clip.

9. The electronic device according to claim 7 wherein the device comprises a charging device.

10. The electronic device according to claim 7 wherein the device comprises an article of clothing and the detection means determines retention by the article of clothing.

11. The electronic device according to claim 1 wherein the sensor means comprises an electromechanical switch activated by the other object.

12. The electronic device according to claim 1 wherein the sensor means comprises receptor means capable of receiving a signal from the other object.

13. In an electronic device, a method comprising the steps of:

(a) sensing when the electronic device is being worn by a user and when the electronic device is not being worn by said user; and (b) activating a first alert when the electronic device is being worn by the user and and alternatively activating a second alert when the electronic device is not being worn by the user.

14. A selective call receiver comprising:

receiver means for receiving a message information;

sensor means for determining whether the selective call receiver is being worn by a user and when not being worn by said user;

alert selection means for alternatively selecting a first alerting means and a second alerting means in response to the sensor means; and activating means, coupled to the alert selection means, for selectively activating the first and the second alerting means for alerting the user of the received message information.

15. The selective call receiver according to claim 14 wherein the sensor means comprises an electromechanical switch activated when the selective call receiver is placed in a retaining device external to said selective call receiver.

16. The selective call receiver according to claim 14 wherein the sensor means comprises a magnetic sensor.

* * * * *

UNITED STATES PATENT AND TRADEMARK OFFICE

CERTIFICATE OF CORRECTION

PATENT NO. : 5,189,389

DATED : February 23, 1993

INVENTOR(S) : DeLuca, et al.

It is certified that error appears in the above-identified patent and that said Letters Patent is hereby corrected as shown below:

Column 4, line 23, after "and", delete --and--.

Signed and Sealed this

Third Day of May, 1994

*Attest:*

*Attesting Officer*

Bruce Lehman

BRUCE LEHMAN

*Commissioner of Patents and Trademarks*

US005189389C1

(12) EX PARTE REEXAMINATION CERTIFICATE (8233rd)

United States Patent
DeLuca et al.

(10) Number: US 5,189,389 C1
(45) Certificate Issued: May 17, 2011

(54) ELECTRONIC DEVICE HAVING POSITION SELECTABLE ALERT MODES

(75) Inventors: Joan S. DeLuca, Boca Raton, FL (US); Michael J. DeLuca, Boca Raton, FL (US)

(73) Assignee: Motorola, Inc., Schaumburg, IL (US)

Reexamination Request:
No. 90/010,587, Jul. 10, 2009

Reexamination Certificate for:

| | |
|---|---|
| Patent No.: | **5,189,389** |
| Issued: | **Feb. 23, 1993** |
| Appl. No.: | **07/513,533** |
| Filed: | **Apr. 23, 1990** |

Certificate of Correction issued May 3, 1994.

(51) Int. Cl.
*G08B 6/00* (2006.01)

(52) U.S. Cl. ..... 340/7.58; 340/7.32; 340/7.6; 340/571; 340/689; 455/100

(58) Field of Classification Search ..... None
See application file for complete search history.

(56) References Cited

U.S. PATENT DOCUMENTS

| | | | |
|---|---|---|---|
| 4,325,142 | A | 4/1982 | Nakazawa |
| 4,853,674 | A | 8/1989 | Kiss |
| 4,879,759 | A | 11/1989 | Matsumoto et al. |
| 4,904,992 | A | 2/1990 | Grothause |
| 4,918,438 | A | 4/1990 | Yamasaki |

FOREIGN PATENT DOCUMENTS

| | | |
|---|---|---|
| JP | S62-175033 | 7/1987 |

*Primary Examiner*—Roland G Foster

(57) ABSTRACT

An electronic device (FIG. 1) includes a sensor (17) for determining when the electronic device (FIG. 1) is being worn by a user and when the electronic device (FIG. 1) is not being worn by the user. A first altering device (21) provides a first alert and a second altering device (22) provides a second alert. An alert selection device (16) which is coupled to the sensor (17) alternatively activates the first alerting device (21) when the electronic device (FIG. 1) is being worn by the user and the second altering device (22) when the electronic device (FIG. 1) is not being worn by the user.

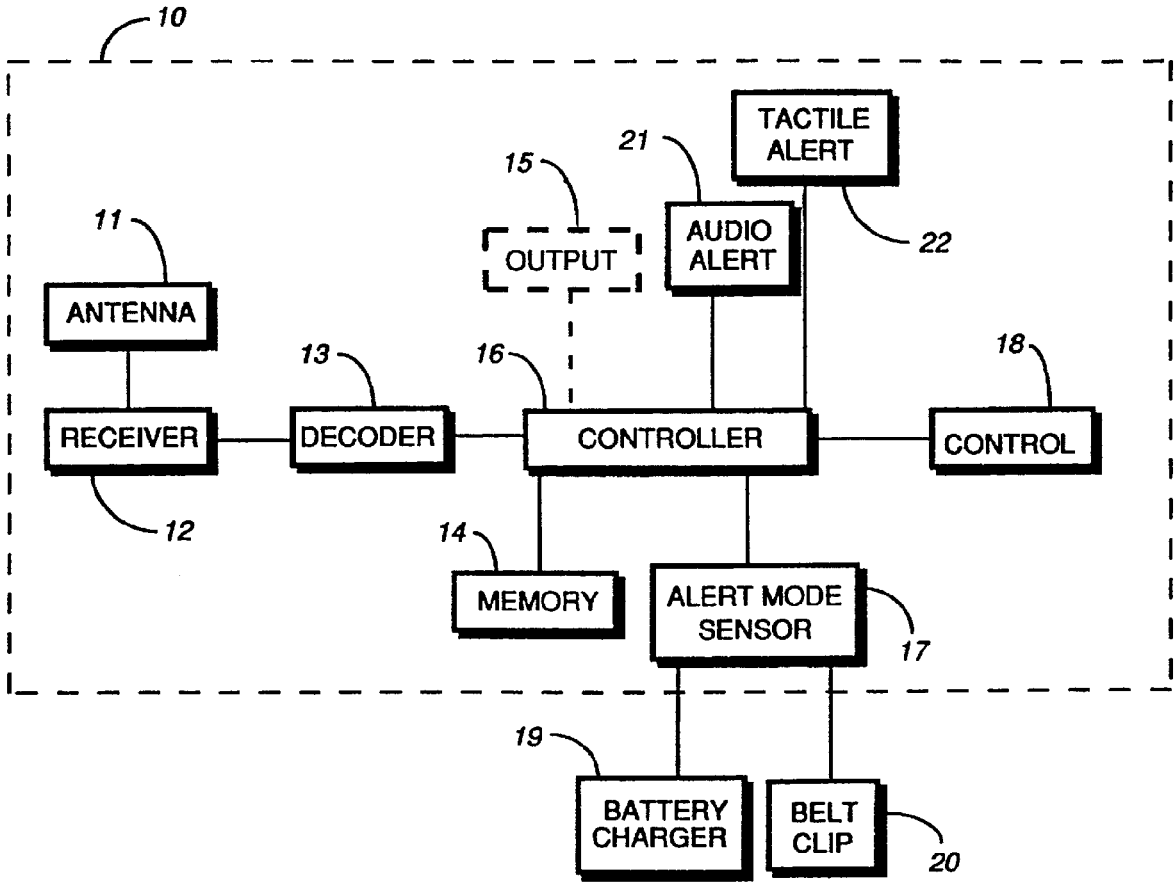

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1-12 and 14-16 is confirmed. Claim 13 is cancelled.

* * * * *